US006832458B2

(12) United States Patent
Sander et al.

(10) Patent No.: US 6,832,458 B2
(45) Date of Patent: Dec. 21, 2004

(54) QUICK-CONNECTOR FOR REBAR TO CONCRETE DOWELS

(75) Inventors: Bernhard Sander, Feldkirch (AT); Joachim Günther, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 127 days.

(21) Appl. No.: 10/079,787

(22) Filed: Feb. 20, 2002

(65) Prior Publication Data

US 2002/0112436 A1 Aug. 22, 2002

(30) Foreign Application Priority Data

Feb. 21, 2001 (DE) ..... 101 08 231

(51) Int. Cl.[7] ..... E04C 5/16

(52) U.S. Cl. ..... 52/677; 52/712; 52/649.8; 52/649.7; 52/688; 248/742; 404/135; 404/63; 403/397

(58) Field of Search ..... 52/677, 649.7, 52/649.8, 684–689, 650.1, 650.2, 712, 651.06; 403/397; 404/60–65, 135–136; 248/742

(56) References Cited

U.S. PATENT DOCUMENTS 1,119,123 A * 12/1914 Schoenthaler ..... 52/686
1,629,485 A * 5/1927 Dewey ..... 52/689
1,835,806 A * 12/1931 Olmsten et al. ..... 52/685
4,000,591 A 1/1977 Courtois
4,640,063 A * 2/1987 Ayala ..... 52/127.3
5,242,249 A * 9/1993 Grayson ..... 405/286
6,019,546 A * 2/2000 Ruiz ..... 404/134

FOREIGN PATENT DOCUMENTS

| | | |
|---|---|---|
| DE | 19813565 | 9/1999 |
| FR | 2033467 | 4/1970 |
| GB | 1405083 | 9/1975 |

* cited by examiner

*Primary Examiner*—Winnie Yip
(74) *Attorney, Agent, or Firm*—Sidley Austin Brown & Wood, LLP

(57) ABSTRACT

A quick-connector for terminal fastening of a penetrating rebar (7) to a perpendicularly oriented concrete dowel (2), the connector comprising a wire clip (1) having a deflected segment of wire of the length (L) at least partially made of resilient-elastic metal, wherein the wire clip (1) includes, with respect to a primary turning arc (3), arms (5, 5') that are mirror-symmetrical to an angle-bisecting plane (4), wherein each arm (5, 5') forms a deflected secondary turning arc (6, 6') transverse to the primary turning arc (3) and a clippable hook (8, 8') that rests force-lockingly into a radial external surface zone (9), of a terminal radial expansion (1), of the concrete dowel (2).

3 Claims, 3 Drawing Sheets

QUICK-CONNECTOR FOR REBAR TO CONCRETE DOWELS

BACKGROUND OF THE INVENTION

The invention relates to a quick-connector for the terminal fastening of a penetrating reinforcement or rebar to a dowel oriented perpendicular to it and having a terminal radial expansion.

Concrete dowels are designed as intermediate layer connectors with a fastening means, preferably fastened in cured concrete, in a blind bore, using reaction resin mortars, and an embedding means later embedded in wet concrete. The dowels have terminal radial expansions for receiving tensile loads. Such expansions are, for example, conical expansions of a tubular element in the form of a concrete dowel.

According to U.S. Pat. No. 3,163,266 a resilient wire clip is used as a quick-fastener for unassisted assembly of two light-weight continuous panels that are oriented perpendicular to each other. The clip includes a primary turning arc of 150° and lateral arms each having a secondary turning arc of 180° running perpendicular to its respective arm. The secondary turning arc serves as a form-fitting wrap-around hook for a light-weight panel, the lateral arms are deflected 90° at the height of the panel and are fashioned together with a slightly underslung primary turning arc as a clippable hook that grips the width of the light panel.

According to U.S. Pat. No. 4,388,791 a resilient wire clip is used as a quick-fastener for unassisted assembly of two light-weight continuous rebars that are oriented perpendicular to each other. The wire clip includes, in its middle section, a primary turning arc of 180° and parallel running lateral arms each having a perpendicular secondary turning arc of 120°, wherein each secondary turning arc is clippable over the rebar and force-fittingly fixes the rebar to the other rebar.

SUMMARY OF THE INVENTION

The object of the present invention is to provide a removable quick connector for the terminal fastening of a penetrating rebar to a concrete dowel. A further object is to provide a single-handedly mountable variant.

The object is essentially achieved by the quick-connector of the present invention. In accordance with the invention, there is provided a quick connector, preferably, in the form of a wire clip comprising a wire loop with a bent segment of wire at least partially made of resilient elastic metal with a thickness between 2 and 8 mm. The wire loop is at an angle of approximately between 90° to 180° relative to a primary turning arc, wherein the primary turning arc receives the concrete dowel on one side, and has a half length with a radius greater than or equal to the non-radially expanded diameter of the associated concrete dowel. The primary turning arc has arms that are mirror-symmetrical to a plane dividing the angle in half, wherein each arm unilaterally receives an associated rebar. A secondary turning arc is deflected essentially perpendicular to the primary turning arc at an angle between 90° and 360° and has a radius greater than or equal to the diameter of the rebar. Each arm, at its end, is essentially deflected perpendicular to the primary turning arc. Each arm is formed into a clippable hook deflected at an angle between 30° and 90° relative to the primary turning arc, wherein the hook force-fittingly extends into the radially external front zone of the terminally radial expansion of the concrete dowel.

The concrete dowel can be wrapped around a radially unexpanded part of the primary turning arc of the wire clip.

The clippable hooks of the arms are resiliently detachable in the terminal radial expansion with a terminal deformation fastened to the primary turning arc. The wire clip is securely force-fittingly fixed at three terminal points on the concrete dowel because the clippable hooks of each arm attach into the radial expansion of the concrete dowel and the primary turning-arc unilaterally encompass the non-radially expanded part. The penetrating rebar is securely force-fittingly fixed between the radially expanded part of the concrete dowel and the secondary turning arcs.

The secondary turning arc is advantageously at an angle of between 90° and 180°, whereby the penetrating rebar can be introduced radially on one side.

A tertiary turning arc at an angle of between 90° and 270° can advantageously be disposed, for each arm, between the secondary turning arc and the clippable hook, whereby the secondary turning arc, in the clippable condition, is deformed to an angle greater than 180°, which fixes therein the penetrating rebar force-fittingly on both sides.

The tertiary turning arc is preferably parallel to the primary turning arc and further advantageous, in the direction of the symmetry plane, crimped, whereby the rebar per arm makes contact with the tertiary arm. As a result of this arrangement, the wire clip is compact.

For each arm, a quaternary turning arc with an angle between 90° and 180° is arranged parallel to the secondary turning arc between the tertiary turning arc and the clippable hook, the quaternary turning arc force-fittingly fixing the rebar and the secondary turning arc.

Other features and advantages of the present invention will become more apparent from the following description of the invention which refers to the accompanying drawings.

DETAILED DESCRIPTION OF THE INVENTION

Figure 1:
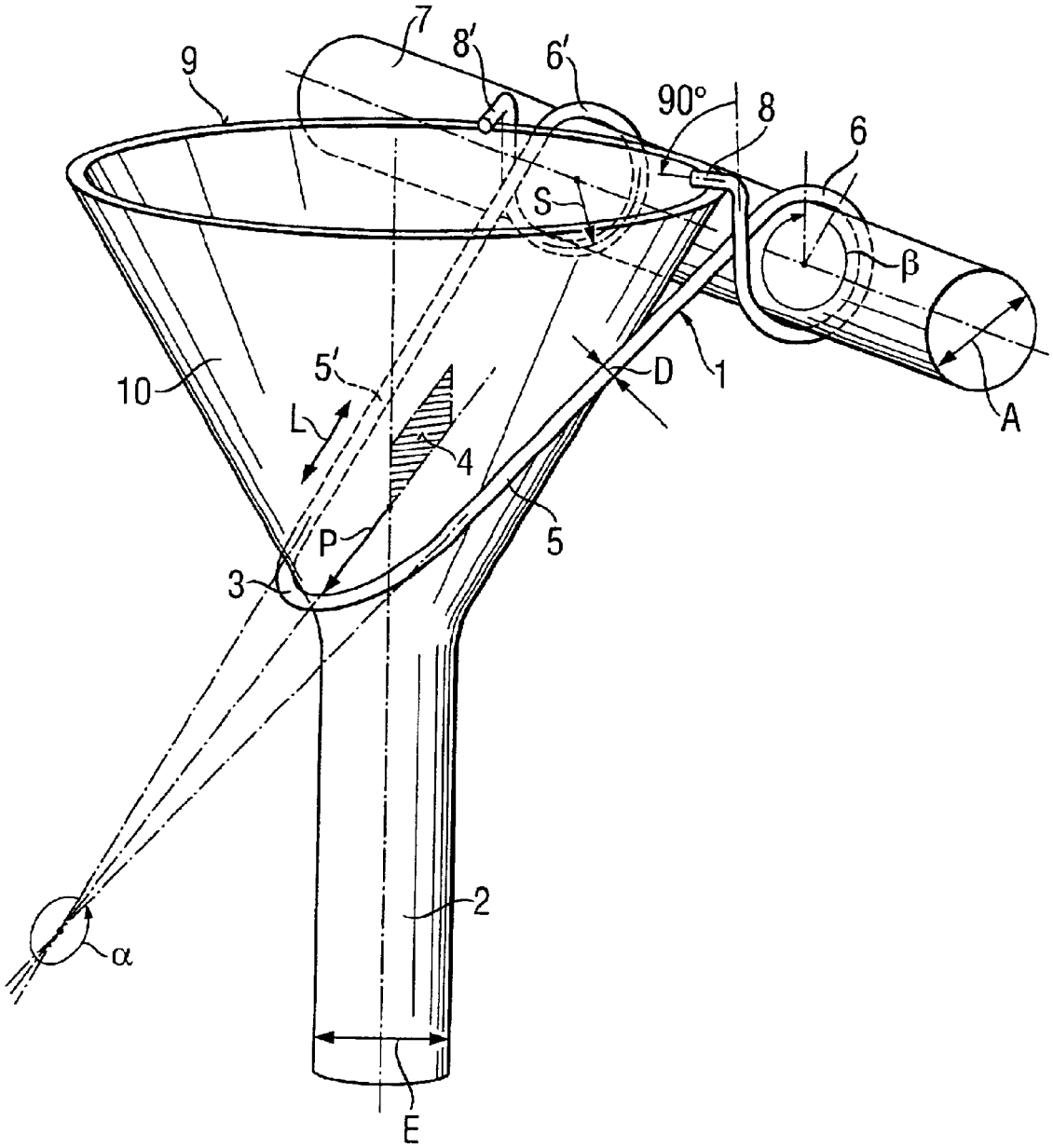
FIG. 1 illustrates a quick-connector, in accordance with the invention.

Referring to FIG. 1, the quick connector, preferably, wire clip 1, comprises a deflected wire segment having a diameter D and a length L. The wire clip 1, by way of primary turning arc 3, receives, on one side, a concrete dowel 2 without a radially expanded diameter E. Primary turning arc 3 has a slightly greater radius P with $\alpha$=120° and half the length of length L. The primary turning arc 3, of the wire clip 1, forms two arms 5, 5' that are mirror-symmetrical to the angle-bisecting plane 4. Each arm forms the secondary turning arc 6, 6' with $\beta$=300°, which is deflected perpendicular to the primary turning arc 3 and oriented opposite the terminal-sided direction of the of the concrete dowel 2. The secondary turning arc 6, 6' has a radius S that is slightly greater than the diameter A of a rebar 7 arranged perpendicular to the concrete dowel 2. For each arm 5, 5' a clippable, inclined hook 8, 8' is formed and deflected perpendicular to the primary turning arc 3 and perpendicular to the secondary turning arc 6, 6', at a 90° angle in the angle-bisecting plane 4. The hook force-fittingly rests in a radial external front zone 9 of a conical, terminal radial expansion 10, of the concrete dowel 2.

Figure 2:
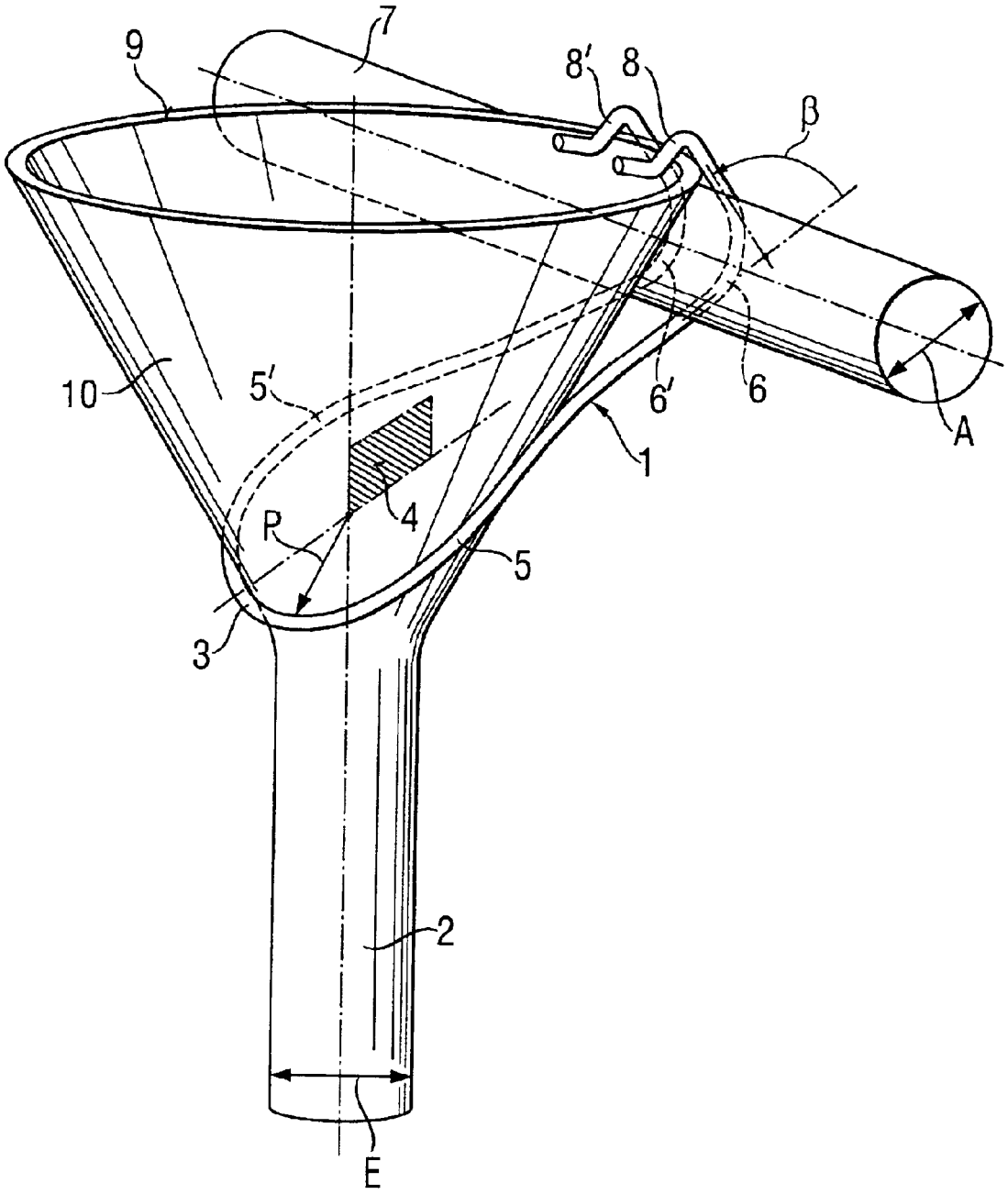
FIG. 2 illustrates a variation of the embodiment of the quick-connector of FIG. 1, in accordance with the invention.

Referring to FIG. 2, a variation of the quick-connector of FIG. 1 is shown. A variant for each of the arms 5, 5' is formed between a secondary turning arc 6, 6' with $\beta=120°$, which is deflected perpendicular to the primary turning arc 3 and oriented towards the terminal sense of the concrete dowel 2. For each arm 5, 5', a hook 8, 8' is formed and deflected perpendicular to the primary turning arc 3 and parallel to the secondary turning arc 6, 6', and inclined at an angle of 60°. The hook rests force-lockingly in the radial external front zone 9 of the conical, terminal radial expansion 10 of the concrete dowel 2.

Figure 3:
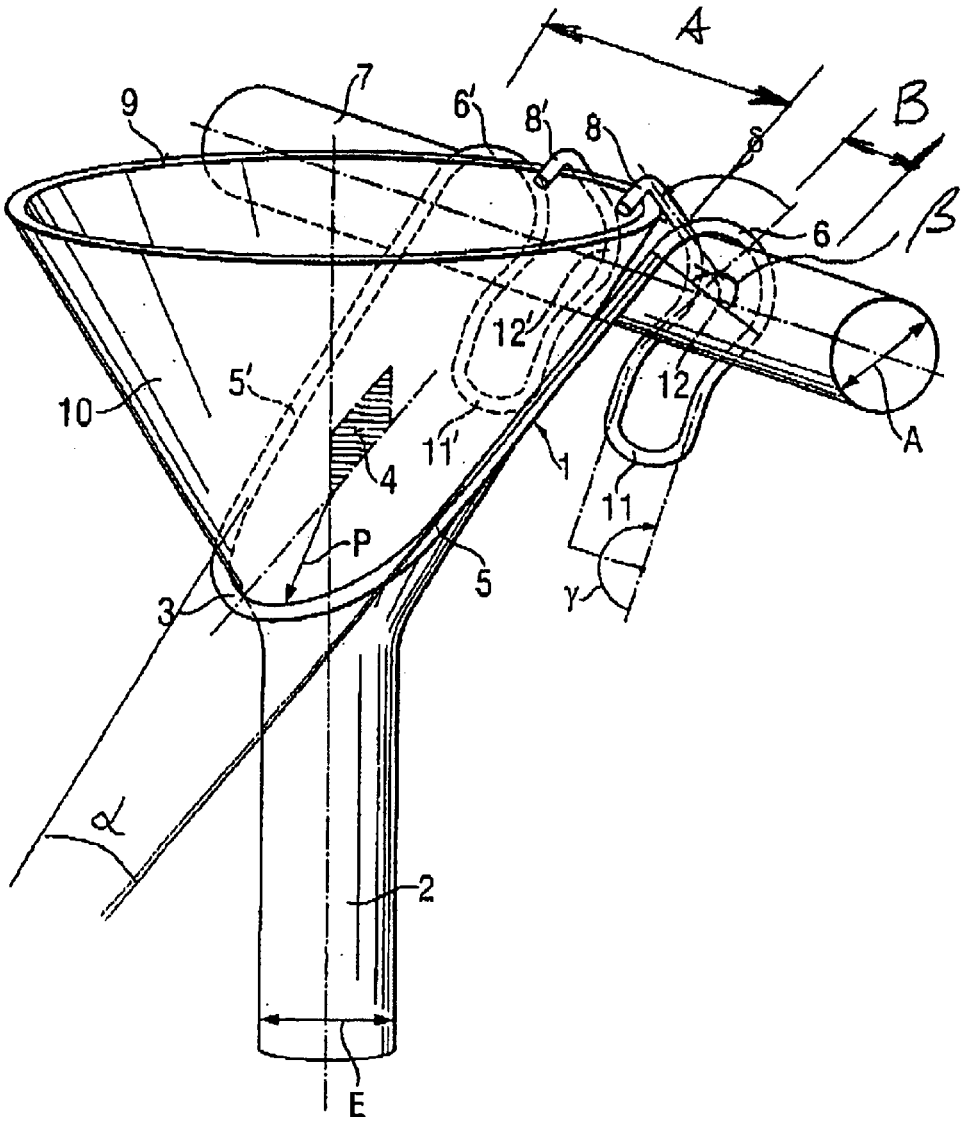
FIG. 3 illustrates a second variation of the quick-connector of FIG. 1, in accordance with the invention.

Referring to FIG. 3, a second variation of the quick-connector is shown. A variant for each of the arms 5, 5' is formed between the secondary turning arc 6, 6' with $\beta=180°$, which is deflected perpendicular to the primary turning arc 3 and oriented opposite to the terminal sense of the concrete dowel 2, and the clippable hook 8, 8'. The clippable hook 8, 8' is inclined at an angle of 90°, by a tertiary turning arc 11, 11', which is parallel to the primary turning arc 3 and perpendicular to the secondary turning arc 6, 6', and deflected towards the angle-bisecting plane 4, at an angle $\gamma=180°$. For each arm 5, 5', a parallel quaternary turning arc 12, 12' having an angle $\delta=90°$ is arranged between the tertiary turning arc 11, 11' and the clippable hook 8, 8' and runs parallel to the secondary turning arc 6, 6'.

What is claimed is:

1. A quick connector for the terminal fastening of a penetrating rebar (7) to a perpendicularly oriented concrete dowel (2), the connector comprising a wire loop (1) including a deflected wire segment of a length (L) at least partially made of a resiliently elastic metal, wherein the wire loop (1) is at an angle ($\alpha$) of approximately between 90° to 180° relative to a primary turning arc (3), the primary turning arc (3) being adapted to receive the concrete dowel and having arms (5, 5') that are mirror-symmetrical to an angle-bisecting plane (4), wherein each arm (5, 5') forms a secondary turning arc (6, 6'), at an angle ($\beta$) of approximately 180°, transverse to the primary turning arc (3), for unilaterally receiving a rebar (7) arranged essentially perpendicular to the concrete dowel (2) wherein each arm (5, 5') carries at its end a clippable hook (8, 8'), transversely angled to the primary turning arc (3), the hook being adapted to force-fittingly rest in a radial external surface zone (9) of a terminal radial expansion of the concrete dowel (2), and wherein each arm (5, 5') includes a tertiary turning arc (11, 11') arranged between the secondary turning arc (6, 6') and the clippable hook (8, 8') at an angle ($\gamma$) between 90° to 270° and each arm (5, 5') includes a quaternary turning arc (12, 12') that is parallel to the secondary turning arc (6, 6') at an angle ($\delta$) between 90° to 180°, and arranged between the tertiary turning arc (11, 11') and the clippable hook (8, 8').

2. The quick-connector of claim 1, wherein the tertiary turning arc (11, 11') is deflected parallel to the primary turning arc (3).

3. The quick-connector of claim 2, wherein the tertiary turning arc (11, 11') is further deflected in a direction towards the angle-bisecting plane (4).

* * * * *